US005689084A

United States Patent [19]

Malotky et al.

[11] Patent Number: 5,689,084

[45] Date of Patent: Nov. 18, 1997

[54] BONDING METHOD AND THE RESULTING ARTICLE

[75] Inventors: Lyle O. Malotky; Marvin A. Pedersen, both of Oxon Hill, Md.; Dana E. Spencer, Woodbridge, Va.

[73] Assignee: The United States of America as represented by the Secretary of the Navy, Washington, D.C.

[21] Appl. No.: 519,468

[22] Filed: Oct. 25, 1974

[51] Int. Cl.[6] ..... F42B 33/06

[52] U.S. Cl. ..... 102/293; 86/50; 89/1.11

[58] Field of Search ..... 102/70 R, 70.2 R, 102/8, 293, 401; 89/1 M, 1 R, 1 A, 1.11; 86/50

[56] References Cited

U.S. PATENT DOCUMENTS

| | | | |
|---|---|---|---|
| 2,404,441 | 7/1946 | Hopkins | 89/1 R |
| 3,138,100 | 6/1964 | Peschko | 102/8 |
| 3,285,400 | 11/1966 | High | 89/1 R |

*Primary Examiner*—Charles T. Jordan

[57] ABSTRACT

A filler combined with a quick-setting adhesive such as a cyanoacrylate adhesive, or an anaerobic adhesive forms an adhesive composite having high compressive strength suitable for immobilizing a mechanical fuze.

4 Claims, No Drawings

BONDING METHOD AND THE RESULTING ARTICLE

BACKGROUND OF THE INVENTION

This invention relates to a fuze and more specifically to an inactivated fuze, and a method for inactivating a fuze.

Many types of fuzes are known in the art. A fuze is generally used to detonate an explosive encompassed in typical war material or munition, an improvised explosive device, or a manufactured explosive device. The fuze is critical to the operation of these devices, because if the fuze does not function, the device may not detonate. Detonate, hereafter, means the initiation of an explosive or incendiary material, the release of an agent or the execution of the munition design.

A favorite means of terrorists, criminals and other misguided persons for attracting notoriety or infamy is to manufacture or improvise and then attempt to use, an explosive device. This device usually comprises an explosive, an anti-disturbance firing mechanism, and a time controlled detonating device which permits the misguided person to arm the device, place it in the area he desires to wantonly destroy, and escape without harm to himself while leaving his device to threaten life and property. On many occasions, such clandestine explosive devices are discovered before they detonate. If the explosive is separated from the detonation mechanism or if the fuse is inactivated, before the time of explosion, the damage to life and property from the explosion is avoided.

Previous methods for inactivating these devices have been highly dangerous and very difficult to use. There is always the critical time factor requiring inactivation before the arrival of the time for the device to detonate, The device can also be designed to detonate prematurely if moved or opened thereby complicating disarming of the device. Frequently, the timing and premature detonation factors prevent removal of the device to a place where it may detonate without danger to life and property. Thus it is necessary to inactivate the device, where it is found, at great danger to life and property. While the area threatened by the device can be cleared of people, the device still remains dangerous to the property in proximity thereof. An explosive ordnance disposal expert, who attempts to disarm or inactivate the device before detonation, is required to risk his life if he wishes to inactivate the improvised explosive device before detonation thereof with the timing mechanism and possible premature detonation capability threatening his life all the while. Inactivation of these devices is an art depending on the skill of the individual expert, wherein a mistake can be fatal.

The tools available to the disposal expert for rendering any explosive device, including an improvised explosive device (IED), safe are substantially limited. As stated above, the safest technique is to detonate the device in place. However, due to the danger of life and property this technique is not always feasible. Another safe technique is to move the device to an isolated area and detonate it. The time factor combined with possible premature detonation due to anti-disturbance mechanisms which are activated by movement of the device renders this movement unsuitable. Thus, while hand entry and hand disassembly of the device by an explosive ordnance disposal expert present hazards to the expert, it remains the most suitable way to inactivate such a device.

Many efforts are expended to change the expert's art into a science and therefore, make disarming of explosive devices safer—especially those devices having mechanical fuses. Mechanical fuzes, with which the expert must deal, by definition, have moving parts, whether it be a clockwork, a fatiguing piece of metal or plastic, an inertial mass with attached firing pin, or any mechanism where a firing pin is physically moved relative to the detonator. Also any fuze where physical movement of one or more parts of the fuze relative to the rest of the fuze is necessary for the function of the fuze can be considered within the scope of mechanical fuzes. It is necessary for the fuze of an explosive device, a munition, or an improvised explosive device to function if the device is to carry out its desired mission that is to detonate. When an explosive device is deployed on a locale where its detonation is not desired, it is necessary to prevent its function to minimize damage to personal and property.

It is therefore, necessary for the disposal expert to neutralize or render inoperative long delay and dud-fired, dropped or emplaced explosive devices of U.S., foreign, and terrorist origin.

However, no simplified, method of preventing a detonation in such a wide variety of situations is currently available. Thus war material, manufactured explosive devices, and improvised explosive device remain a danger to those people or property in the proximity thereof. Many methods have been proposed for inactivating fuzes and therefore explosive devices such as U.S. Pat. No. 2,404,411 to Hopkins or U.S. Pat. No. 3,285,400 to High. These methods are operable for their specific applications. However, it is desirable to expand these methods and achieve the more general results desired in the instant invention. In another method, Plaster of Paris is used as an agent that can be injected into the cavity of a fuze, which, upon setting will yield a rigid material that either immobilizes all moving parts in the fuze or prevents a striker from reaching a primer detonator. Problems are encountered with Plaster of Paris, particularly with regard to extended set times and the unpredictable presence of voids in the cured mass. Application of heat is required to hasten setting of some known agents, and increases the difficulty of inactivation. Thus, known methods of fuze inactivation are relatively complicated.

The inactivation by hindering fuze function on any type of explosive device requires certain features. Quick setting without excessive heat is required for inactivation or immobilization. If fuze function is blocked by a composition, the composition must be easily applied to the fuze, adhere to the fuze and have high compressive strength when set. The inactivation composition should also be effective against various types of fuzes such as a clockwork fuze, a cocked striker fuze, or an inertial striker fuze. If an inactivating composition has voids on curing or otherwise lacks high compressive strength, it is unreliable and may not inactivate the wide variety of fuzes involved.

SUMMARY OF THE INVENTION

It is therefore, an object of this invention to inactivate a fuze.

Also, it is an object of this invention to render an explosive device safely moveable.

It is a further object of this invention to inactivate an explosive device in situ.

It is a still further object of this invention to prevent premature detonation by anti-disturbance devices.

Another object of this invention is to prevent detonation of ordnance while clearing the ordnance away to a safe place.

Yet another object of this invention is to quickly inactivate a fuze.

Also, it is an object of this invention to inactivate different types of mechanical fuzes with the same composition.

It is a further object of this invention to form a high strength composite for inactivating a fuze in a short period of time without the application of heat.

It is a still further object of this invention to form a high compressive strength composite.

These and other objects of the invention are met by packing a filler around a fuze mechanism and inpregnating the filler with an anaerobic adhesive or a cyanoacrylate.

DESCRIPTION OF THE PREFERRED EMBODIMENTS

A filler combined with an anaerobic adhesive, or a cyanoacrylate late adhesive immobilizes a fuze and prevents detonation because the filler is packed around the fuze mechanism, and the adhesive cures quickly to a solid high compressive strength material. The filler and adhesive are effective because they are easily positioned around the fuze components, set quickly without the application of heat, have high compressive strength, and have good adhesion to the fuze components.

The filler is any suitable particulate material such as metal powders or microspheres such as glass microspheres, ceramic microspheres or plastic microspheres. Such fillers are standard and well-known in the art. The microspheres are desirable as fillers for inactivation of fuzes because of their free flow. Standard well known procedure for producing microspheres are set forth in U.S. Pat. No. 2,978,340 to Veatch et al, U.S. Pat. No. 3,264,073 to Schmitt, U.S. Pat. No. 2,806,509 to Bozzacco et al and U.S. Pat. No. 3,786,134 to Amagi et al all of said patents being incorporated herein by reference. A suitable size for the filler is 0.002 to 0.04 inches(0.05 to 1.0 millimeter) in diameter. A more suitable size for the filler is: 0.005 to 0.025(0.12 to 0.62 millimeter) in diameter. The most suitable size for the filler is: 0.01 to 0.02 inches(0.25 to 0.5 millimeter) in diameter.

Glass microspheres are the preferred filler because they:

1. free flowing due to their spherical shape, size and lack of sharp corners or edges;
2. have very high compressive modulus giving an unyielding high strength composite;
3. are inexpensive and commercially available in a wide assortment of sizes and surface treatments; and
4. have a microscopic layer of water characteristically absorbed on glass in equilibrium with air to act as the ideal catalyst for cyanoacrylate polymerization and curing.

Standard soil is also suitable for use as a filler, because application of the adhesive substantially immobilizes it.

Suitable adhesives for use with the fillers in inactivating are of the anaerobic type, the two component premixed types, or the cyanoacrylate type. The cyanoacrylate adhesives are well-known in the art as evidenced by U.S. Pat. No. 3,653,635 to Bannitt, and U.S. Pat. No. 3,780,084 to Schaafsma, all patents being incorporated by reference—especially because they disclose methods for making the desired adhesive. These adhesives are self-curing and basically cure on exposure to moisture. An especially suitable adhesive is methyl cyanoacrylate. A mixture of n-hexyl cyanoacrylate and methyl cyanoacrylate is also a suitable adhesive for the purpose of this invention. These adhesives, in combination with microspheres, form an adhesive composite with high compressive strength that is greater than 6,000 psi(420 kilograms per square centimeter). Microspheres are applied to the fuze area in any suitable fashion.

Microspheres are introduced by gravity (they flow as a liquid), or by co-injection with a stream of air. The air (or inert gas) serves to fluidize the microspheres. The gas source is manual or mechanical pump, or a pre-pressured storage container. The gas is also blown into a void inducing the microspheres to flow with the gas. The beads are added to the gas stream by gravity or vacuum. Additionally, the microspheres can be contained in a squeeze bottle and expelled by alternately squeezing and releasing the bottle. The microspheres or other fillers are inserted in the fuze housing or positioned by a temporary mold, merely placed on the fuze, otherwise suitably positioned.

After the glass microspheres are positioned, sufficient adhesive is added to fill all voids. The low viscosity adhesive flows through the microsphere matrix by capillary action, gravity, or applied pressure. The anionic polymerization of cyanoacrylate adhesive is initiated in this by water absorbed on the surface of the glass microspheres. The formation of a thin bond line and the characteristically high adhesive strength of polycyanoacrylate results in a composite of high rigidity. This composite is not only void filling but also strongly adheres to all surfaces contacted The adhesive is added to the filler in any standard fashion—such as by means of a hypodermic syringe.

The rapid set, rigidity and adhesion of the composite, which cures in place without application of heat, lends this system to fuze gagging. The adhesion of a composite of cyanoacrylate and glass microspheres to a steel wire is over 500 pounds/square inch of wire. Lack of creep in the composite as it is subjected to compressive loading makes it superior to polymeric gagging systems. The removal of the composite from a gagged fuze for intelligence purposes can be accomplished by soaking the fuze in the appropriate solvents.

It is also possible to perform this immobilization with anaerobic adhesives as well as cyanoacrylate, some anaerobic adhesives have a low viscosity with a high tendency to wick or spread rapidly through the microspheres. Metal, plastic, glass or ceramic microspheres, or any combination thereof, should be useable as well. However, cyanoacrylate remains the preferred adhesive due to its quick setting and high adhesiveness. For maximum strength sufficient adhesive should be added to fill all voids in the filler. It should be noted that many other materials of the appropriate particle size can be immobilized or stabilized by cyanoacrylate adhesive. Ordinary dry soil for example, has been immobilized into a rigid composite simply by the addition of cyanoacrylate adhesive.

Free flowing microspheres are quickly immobilized, forming an adhesive composite of high compressive strength. This composite formed in situ, will find use in the immobilization of fuze ordnance and can be used as a void filling structural component.

Hollow glass microspheres can be immobilized, providing flotation and structural rigidity to various structures and vessels of unique design. The ease of changing the configuration of the composite by the addition of microspheres and adhesive will lend itself to modification and repair of the composite structural components.

In the following examples which are intended to illustrate without unduly limiting the invention all parts and percentages are by weight unless otherwise specified.

EXAMPLE I

A standard commercially available rat trap of the spring loaded type is set. About 30 cubic centimeters (cc) of 0.15 inch diameter glass microspheres are poured around the mechanism onto the trap without tripping the trap mechanism. About 10 cc of methylcyanoacrylate is added to the microspheres in order to fill the voids between the microspheres. After 30 seconds attempts to spring the trap are unsuccessful. The methylcyanoacrylate sets and immobilizes the trap. The composite has bonded the metal parts to the wooden base. The function of a rat trap is adaptable to a mechanical fuze.

EXAMPLE II

The procedure of Example I is followed using a microswitch instead of a trap. About 0.010 inch (0.25 millimeters) movement of a pin on a Model 2HB-1 microswitch allows switching to take place. The pin has 300 gram force pushing units. The pin is mechanically depressed. About 4 cc of 015 inch (0.37 millimeters) diameter glass microspheres are spread about the pin. Three drops of methylcyanoacrylate is added to the beads. In 30 seconds the mechanical pressure on the pin is released. No switching takes place as verified by a resistance check on the switch. The glass microsphere composite securely bonds the pin to the plastic body of the switch. Micro switches are customarily used as anti-disturbance devices.

Obviously numerous modifications and variations of the present invention are possible in light of the above teachings. It is therefore to be understood that, within the scope of the appended claims, the invention may be practiced otherwise than as specifically described.

What is claimed as new and desired to be secured by Letters Patent of the United States is:

1. A method of inactivating a fuze comprising:

(a) allowing a filler material to flow around fuze components;

(b) applying quick setting adhesive to said filler material;

(c) said adhesive being at least one adhesive selected from the group consisting of a cyanoacrylate adhesive and an anaerobic adhesive; and (d) allowing said adhesive to cure.

2. The method of claim 1 wherein said filler material is at least one filler selected from the group consisting of dry earth, metallic microspheres or particles, glass microspheres, plastic microspheres, ceramic microspheres.

3. The method of claim 2 wherein said adhesive is a self-curing cyanoacrylate.

4. The method of claim 3 wherein the filler is glass microspheres.

* * * * *